United States Patent [19]

Gorzegno et al.

[11] 4,116,168

[45] Sep. 26, 1978

[54] VAPOR GENERATING SYSTEM UTILIZING INTEGRAL SEPARATORS AND ANGULARLY ARRANGED FURNANCE BOUNDARY WALL FLUID FLOW TUBES

[75] Inventors: Walter P. Gorzegno; Juan Antonio Garcia-Mallol, both of Morristown, N.J.

[73] Assignee: Foster Wheeler Energy Corporation, Livingston, N.J.

[21] Appl. No.: 791,830

[22] Filed: Apr. 28, 1977

[51] Int. Cl.[2] ..... F22B 29/02; F22D 7/00

[52] U.S. Cl. ..... 122/406 S; 122/510

[58] Field of Search ..... 122/6 A, 235 R, 235 A, 122/250 R, 406 E, 406 SU, 510

[56] References Cited

U.S. PATENT DOCUMENTS

| | | | |
|---|---|---|---|
| 1,895,790 | 1/1933 | Eule | 122/250 |
| 3,038,453 | 6/1962 | Armacost | 122/406 |
| 3,125,073 | 3/1964 | Profos | 122/406 |
| 3,400,689 | 9/1968 | Bagley et al. | 122/510 |
| 3,832,979 | 9/1974 | Ammann | 122/235 |

*Primary Examiner*—Kenneth W. Sprague

*Attorney, Agent, or Firm*—Marvin A. Naigur; John E. Wilson; John J. Herguth, Jr.

[57] ABSTRACT

A vapor generating system in which a vapor generating section and a superheating section are connected in a series flow relationship with a fluid separating section extending between the vapor generating section and the superheating section. The vapor generating section includes an upright furnace section formed by a plurality of tubes, a portion of which extend at an angle with respect to the horizontal plane for passing fluid through the length of the furnace section to convert a portion of the fluid to vapor or to heat the fluid.

16 Claims, 5 Drawing Figures

VAPOR GENERATING SYSTEM UTILIZING INTEGRAL SEPARATORS AND ANGULARLY ARRANGED FURNANCE BOUNDARY WALL FLUID FLOW TUBES

BACKGROUND OF THE INVENTION

This invention relates to a vapor generating system and more particularly to a sub-critical or supercritical once-through vapor generating system for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as superheated vapor for use in driving a turbine, or the like.

Although these arrangements provide several improvements over conventional drum-type boilers, some problems have arisen in connection with starting up the generators, usually stemming from fluid at an undesirable quantity or condition being passed to the components of the system, resulting in excessive thermal losses, as well as mismatching of temperature of the throttle steam to the turbine inlet causing a decrease in turbine component life.

Earlier attempts to solve some of these problems included arrangements providing bypass circuitry for a portion of the fluid at a point in the flow circuitry between the vapor generating and superheating sections and/or between the superheating section and the turbine during start-up to apportion flow within the system and yet avoid the possibility of fluid at an undesirable quantity or condition being passed to the turbine. However, these arrangements resulted in very poor heat recovery, and, therefore, operated at a reduced thermal efficiency and, moreover, resulted in relatively unsuitable turbine throttle vapor conditions for rolling and bringing the turbine up to speed prior to loading.

Attempts to alleviate the latter problems included installing a division valve in the main flow path to divert flow to a bypass circuit including a flash tank separator located between the vapor generating section and the superheating section, or between a primary and finishing superheater in the superheating section. In these arrangements, the flash vapor from the separator is furnished to the superheating section or to the finishing superheater, and the drains from the separator are passed to a deaerator and/or high pressure heater. However, in these systems, the separator could often accommodate only a limited pressure, which was considerably less than the full operating pressure of the main pressure parts. Therefore, after start-up when turbine demands approached pressures exceeding the design pressure of the separator, the separator had to be switched out of operation and flow to the turbine supplied directly from the main flow line upstream of the flash tank. However, this switch of flow often caused control difficulties and, in addition, caused a drop in enthalpy at the turbine since the flow source switched from a saturated vapor from the separator to a lower enthalpy water-vapor mixture from the main flow line. Therefore, in order to avoid pressure excursions and an uncontrolled significant temperature drop at the turbine throttle, the valve controlling flow to the turbine directly from the main flow line had to be opened very slowly, the firing rate had to be increased, and the separator outlet valve closed to slowly transfer the sources of turbine steam from the separator to the main flow line. This of course, resulted in a considerable expenditure of time and energy, and a considerable sophistication of controls.

Also, in these latter arrangements, when vapor formed in the separator in response to a start-up firing rate input, the vapor, in addition to flowing to the turbine, was routed to other areas of the system such as high pressure heaters and/or the condenser until a percentage of the final turbine load was achieved. Therefore, these arrangements required the use and operation of several valves which added to the labor and costs in the operation of the system.

In order to overcome the foregoing problem, it has been suggested to provide a separator or separators directly in the main flow line between the vapor generating section and the superheating section. However, some of these arrangements have proven to be costly due to the fact that a relatively large, thick walled separator, and associated components, have to be used. Also, in some of these arrangements the vapor initially formed in the separator is passed in a circuit bypassing the finishing superheater and the turbine during start-up, after which the flow is switched to the superheater and turbine, which also requires a control system utilizing a number of valves. In order to alleviate the latter problems, the system disclosed in U.S. patent application Ser. No. 713,313 filed on Aug. 10, 1976, and assigned to the assignee of the present invention, includes a plurality of separators disposed in the main flow line between the vapor generating section and the superheating section and adapted to receive fluid flow from the vapor generating section during start-up and full load operation of the system. In this arrangement, the boundary walls of the furnace section of the generator are formed by a plurality of vertically extending tubes having fins extending outwardly from diametrically opposed portions thereof with the fins of adjacent tubes being connected together to form a gas-tight structure. During start-up the furnace operates at constant pressure and super-critical water is passed through the furnace boundary walls in multiple passes to gradually increase its temperature. The system requires the use of headers between the multiple passes to mix out heat unbalances caused by portions of the vertically extending tubes being closer to the burners than others or receiving uneven absorption because of local slag coverage, burners out of service, and other causes. The use of these intermediate headers, in addition to being expensive, makes it undesirable to operate the furnace at variable pressure because of probability of separation of the vapor and liquid phases within the header and uneven distribution to the downstream circuit. Still further, this type of arrangement requires a pressure reducing station interposed between the furnace outlet and the separators to reduce the pressure to predetermined values, and, in addition requires a relatively large number of downcomers to connect the various passes formed by the furnace boundary wall circuitry.

SUMMARY OF THE INVENTION

It is, therefore, an object of the present invention to provide a vapor generating system incorporating a start-up system which does not require the use of bypass circuitry incorporating a low pressure flash tank separator.

It is a further object of the present invention to provide a system of the above type in which a plurality of separators are utilized which together operate at full system pressure and thus eliminate the need for a relatively large, thick-walled separator, while enabling the turbine to be smoothly loaded at pressures and temperatures that constantly and gradually increase.

It is a still further object of the present invention to provide a system of the above type in which vapor initially forming in the separators is immediately passed in the main vapor circuit containing the superheater section and the turbine, to eliminate the controls and valves required to initially route the vapor elsewhere.

It is a still further object of the present invention to provide a system of the above type in which the separators are disposed in a series flow relationship in the main fluid flow circuit between the generating section and the superheating section.

It is a still further object of the present invention to provide a system of the above type in which the vapor generating system includes a furnace section, the walls of which are formed by a plurality of interconnected tubes, a portion of which extends at an acute angle with respect to a horizontal plane.

It is a still further object of the present invention to provide a vapor generating system of the above type in which the fluid passes through the boundary wall circuitry of the furnace section in one single complete pass.

It is a still further object of the present invention to provide a vapor generating system including a furnace section defined by walls formed by a plurality of interconnected tubes extending vertically in the lower and upper portions of the furnace section and extending at an acute angle with respect to a horizontal plane in the intermediate portion of the furnace section.

Toward the fulfillment of these and other objects the system of the present invention includes a vapor generating section for receiving a heat exchange fluid and applying heat to said fluid, a superheating section for applying additional heat to the fluid, fluid flow circuitry connecting the vapor generating section to the superheating section. A plurality of separators are connected in the fluid flow circuitry in a series flow relation with said vapor generating section and the superheating section for receiving fluid from the vapor generating section during start-up and full load operation of the system and separating the fluid into a liquid and a vapor for the start-up and low load operation. The separated vapor is passed in the fluid flow circuitry to the superheating section, and drain liquid flow circuit means are connected to the separating means for passing the liquid from the separating means. The vapor generating section includes a furnace section the walls of which are formed by a plurality of tubes having fins extending outwardly from diametrically opposed portions thereof, with the fins of adjacent tubes being connected together to form a gas-tight structure. A portion of the latter tubes extend at an acute angle with respect to a horizontal plane.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
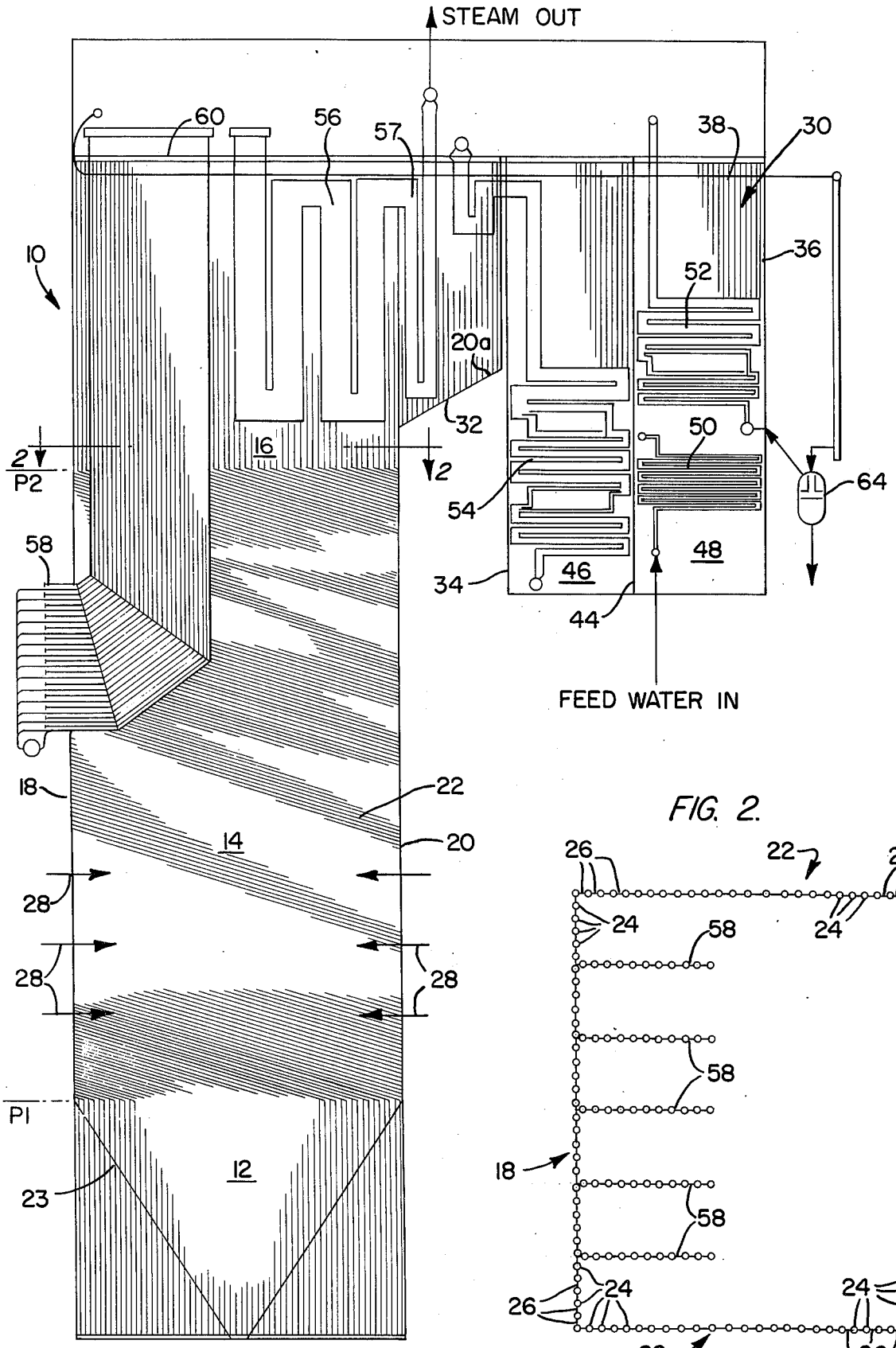
FIG. 1 is a schematic sectional view of the vapor generating system of the present invention.

Referring specifically to FIG. 1 of the drawings, the reference numeral 10 refers in general to a vapor generator utilized in the system of the present invention and including a lower furnace section 12, an intermediate furnace section 14, and an upper furnace section 16. The boundary walls defining the furnace sections 12, 14 and 16 include a front wall 18, a rear wall 20 and two side walls extending between the front and rear wall, with one of said side walls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
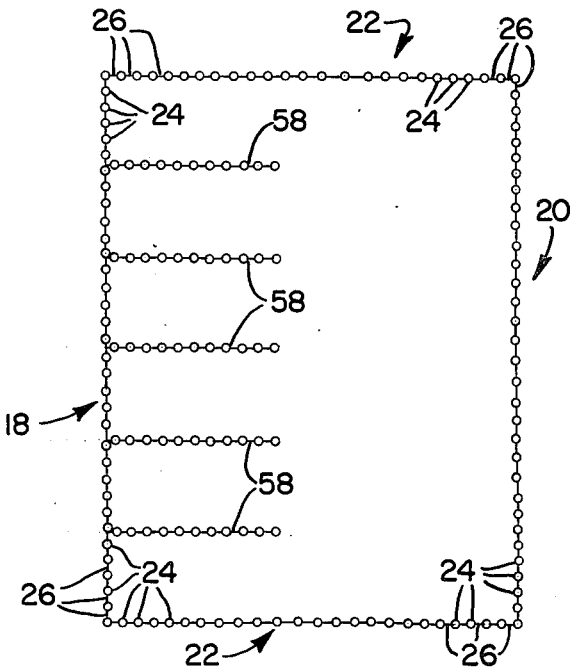
FIG. 2 is a sectional view taken along the line 2—2 of FIG. 1.

As shown in FIG. 2, each of the walls 18, 20 and 22 are formed of a plurality of tubes 24 having continuous fins 26 extending outwardly from diametrically opposed portions thereof, with the fins of adjacent tubes being connected together to form a gas-tight structure.

Figure 3:
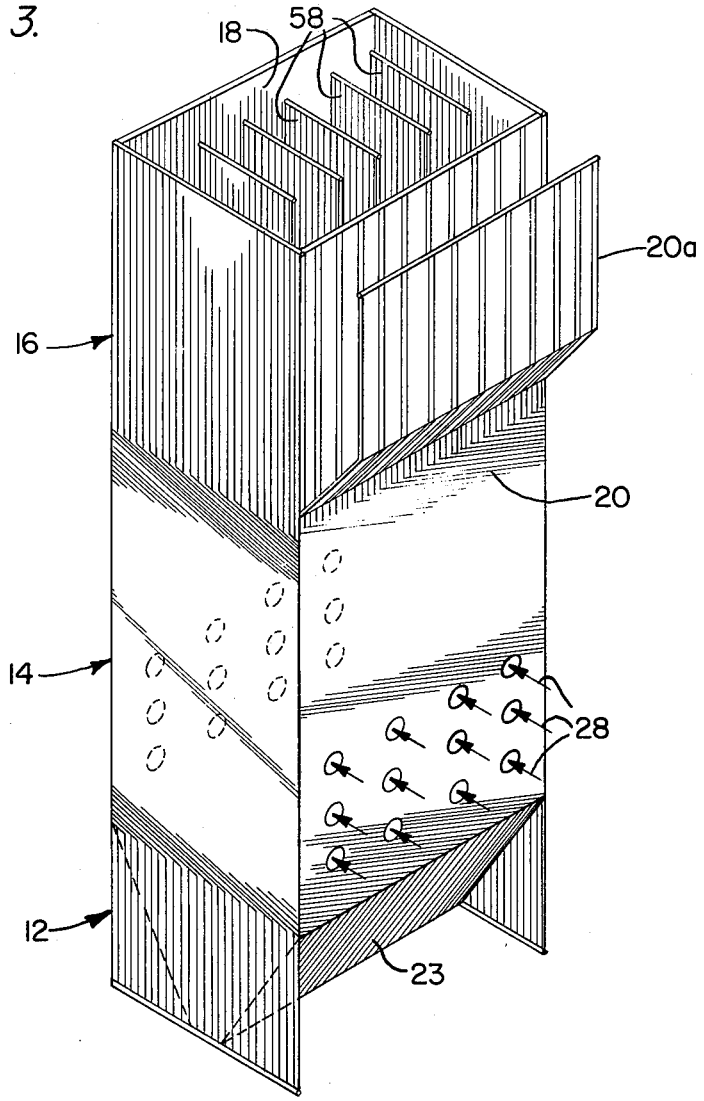
FIG. 3 is a partial perspective view of a portion of the vapor generating system of the present invention.

Referring specifically to FIGS. 1 and 3, the tubes in the side walls 22 of the lower furnace section 12 extend in a vertical fashion up to a horizontal plane P1 located at the upper portion of the hopper section 23. The tubes 24 forming the walls 18, 20 and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20 and 22 of the upper furnace section 16 extend in a vertical direction from the plane P2 to the top of the latter section.

The tubes 24 in the intermediate section 14 extend from plane P1 and wrap around for the complete perimeter of the furnace at least one time to form the walls 18, 20 and 22 before they terminate at plane P2. Tubes having approximately the same diameter are utilized throughout the three furnace sections 12, 14 and 16 and bifurcations are provided at the planes P1 and P2 so that each angularly extending tube 24 in the intermediate furnace section 14 bifurcates into two vertically extending tubes in the upper furnace section 16 in a conventional manner. In a similar manner each tube 24 in the intermediate section 14 bifurcates into two vertically extending tubes in the side walls 22 of the hopper section 12, with the tubes 24 of the front wall 18 and the rear wall 20 extending at an angle to form the hopper slope.

As also shown in FIGS. 1 and 3, the upper portion of the rear wall 20 in the upper section 16 has a branch wall **20*a* which is formed by bending a selected number of tubes 24 from the rear wall 20 outwardly in a manner to define spaces between the remaining tubes 24 in the wall 20** and between the tubes forming the branch wall 20*a* to permit combustion gases to exit from the upper furnace section 16, as will be described later.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

A vestibule-heat recovery area, shown in general by the reference numeral 30 is provided in gas flow communication with the upper furnace section 16 and includes a vestibule floor 32 defined in part by portions of the tubes 24 forming the branch wall 20*a*. The area 30 also includes a front wall 34 which extends upwardly and forms a screen to match vertical portions of the tubes of the branch wall 20*a*, a rear wall 36 and two side walls 38 one of which is shown in FIG. 1. It is understood that the vestibule floor 32 is rendered gas-tight and that the front wall 34 and rear wall 36 of the vestibule-heat recovery area 30 are formed of a plurality of vertically extending, interconnected tubes 24 in a similar manner to that of the upper furnace section 16.

A partition wall 44, also formed by a plurality of interconnected tubes 24, is provided in the vestibule-heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule portion of the vestibule-heat recovery area 30 in direct fluid communication with the platen superheater 56.

A plurality of division walls 58 are provided with each having a portion disposed adjacent the front wall 18. The division walls 58 penetrate a portion of the tubes 24 of the latter wall in the intermediate furnace section 14, and extend upwardly within the upper furnace section 16 as shown in FIGS. 1 and 3.

The upper end portions of the walls 18, 20 and 22, the branch section 20*a*, and the division walls 58, as well as the partition wall 44, side walls 38 and rear wall 36 of the vestibule-heat recovery area 30 all terminate in substantially the same general area in the upper portion of the vapor generating section 10.

A roof 60 is disposed in the upper portion of the section 10 and consists of a plurality of tubes 24 having fins 26 connected in the manner described above but extending horizontally from the front wall 18 of the furnace section to the rear wall 36 of the vestibule-heat recovery area 30.

It can be appreciated from the foregoing that combustion gases from the burners 28 in the intermediate furnace section 14 pass upwardly to the upper furnace section 16 and through the vestibule-heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 60 in fluid communication to establish a flow circuit that will be described in detail later.

A plurality of separators 64 are disposed in a parallel relationship adjacent the rear wall 36 of the vestibule-heat recovery area 30 and are disposed directly in the main flow circuit between the roof 60 and the primary superheater 52. The separators 64 may be identical to those described in the above mentioned patent application and operate to separate the fluid from the roof 60 into a liquid and vapor. The vapor from the separators 64 is passed directly to the primary superheater 52 and the liquid is passed to a drain manifold and heat recovery circuitry for further treatment as also disclosed in the above mentioned application.

Figure 4:
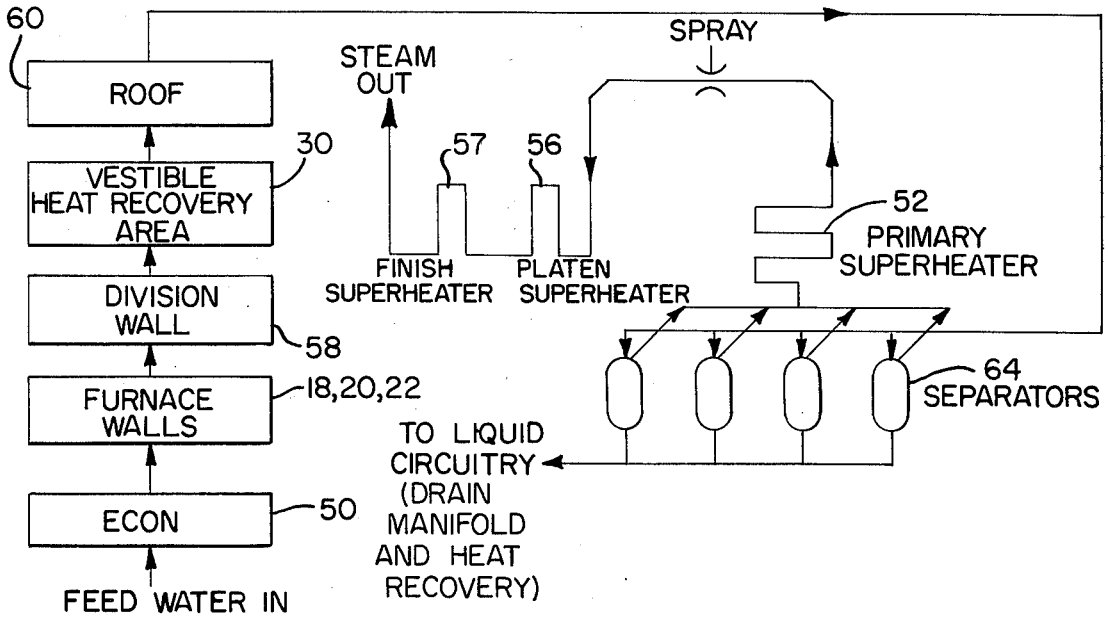
FIG. 4 is a schematic diagram depicting the flow circuit of the vapor generating system of the present invention.

The fluid circuit including the various components, passes and sections of the vapor generating section of FIG. 1 is shown in FIG. 4. In particular, feedwater from an external source is passed through the economizer tubes 50 to raise the temperature of the water before it is passed to inlet headers (not shown) provided at the lower portions of the furnace walls 18, 20 and 22. All of the water flows upwardly and simultaneously through the walls 18, 20 and 22 to raise the temperature of the water further to convert at least a portion of same to vapor, before it is collected in suitable headers located at the upper portion of the vapor generator 10. The fluid is then passed downwardly through a suitable downcomer, or the like and then upwardly through the division walls 58 to add additional heat to the fluid. The fluid is then directed through the walls 34, 36, 38 and 44 of vestibule-heat recovery area 30 after which it is collected and passed through the roof 60. From the roof 60, the fluid is passed via a suitable collection header, or the like, to the separators 64 which separate the vapor portion of the fluid from the liquid portion thereof. The liquid portion is passed from the separators to a drain manifold and heat recovery circuitry (not shown) for further treatment, and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine or the like.

Figure 5:
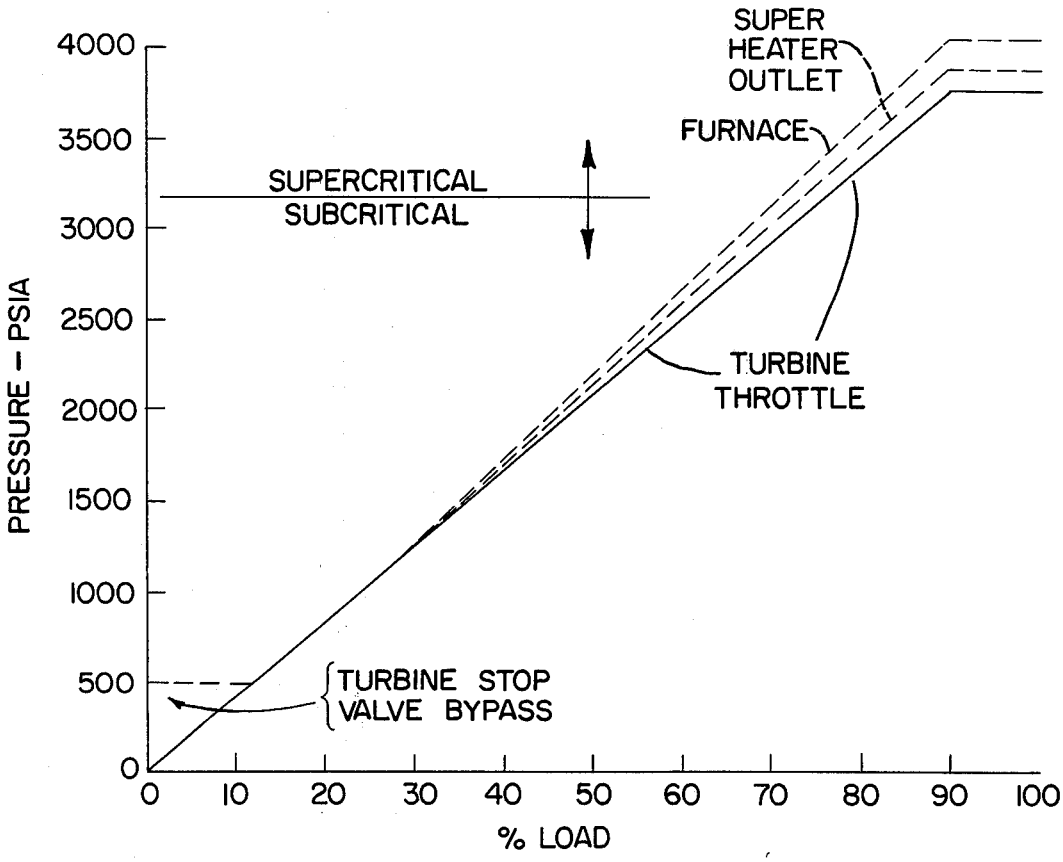
FIG. 5 is a graph illustrating the relationship of throttle pressure versus load for a vapor generator in accordance with the concepts of the present invention.

Referring to FIG. 5, the operation of the vapor generator of the present invention is such that the turbine throttle pressure is increased in response to load demand. A minimum vapor generator circuitry pressure is held to approximately 500 p.s.i. In the range between 12 percent load and 100 percent load, the fluid pressure within the vapor generator circuitry varies essentially in step with the throttle pressure. Below about 12 percent load, the flow to the turbine is throttled through a turbine stop valve bypass. The transition from sub-critical to supercritical flow in the generator circuitry in ramping from 500 p.s.i. to 3500 p.s.i. (12 percent load to 100 percent load) occurs at 3206 p.s.i. It should be understood that the above values for load vs. pressure are typical only, and may vary depending upon the specific design of the vapor generator. The significant feature is that the vapor generator employs a true variable pressure operation. In addition, the pressures in the furnace circuitry are substantially the same as those in the other pressure parts of the generator, allowing for normal pressure losses, and no pressure breakdown is employed between the furnace circuitry and such other pressure parts.

Several advantages result from the foregoing. For example, the separators 64 are connected in the main flow circuit and thus receive the fluid from the vapor generating section 10 during start-up and full load conditions to eliminate the use of bypass circuitry and valving. The use of the angularly extending tubes which wrap around to form the intermediate furnace section 14 enables the fluid to average out furnace heat unbalances and be passed through the boundary walls 18, 20 and 22 of the furnace section in one complete pass, thus eliminating the use of multiple passes and their associated mix headers and downcomers. Also, as a result of the angularly extending tubes, a relatively high mass flow rate and large tube size can be utilized over that possible with vertical tube arrangements.

It is understood that while the preferred embodiment described above includes a furnace having a substantially rectangular shaped cross-sectional area, other cross-sectional configurations such as those having a circular or elliptical pattern may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler," notwithstanding the fact that a true mathematical helix is not generated in a boiler which has a substantially rectangular cross-sectional area.) It is also understood that the tubes may wrap around the furnace for more than one complete revolution, depending on the overall physical dimensions of the furnace.

It is further understood that portions of the vapor generator 10 have been omitted for the convenience of presentation. For example, insulation and support systems can be provided that extend around the boundary walls of the vapor generator 10 and a wind box or the like may be provided around the burners 28 to supply air to same in a conventional manner. It is also understood that the upper end portions of the tubes 24 forming the upper furnace section 16 and vestibule-heat recovery area 30 can be hung from a location above the vapor generating section 10 to accommodate thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generating system comprising a vapor generating section, a fluid separating section, a superheating section, and fluid flow circuitry connecting said sections in a series flow relationship; said vapor generating section comprising an upright furnace section the boundary walls of which are formed by a plurality of tubes, burner means associated with said furnace section, said tubes being directly exposed to heat from said burner means for the entire height of said boundary walls, said tubes extending vertically in the plane of each boundary wall in the lower portions and upper portions of said furnace section walls and extending at an acute angle with respect to a horizontal plane in the intermediate portions of said boundary walls extending between said upper and lower portions, and means for simultaneously passing all of said fluid through said tubes to apply said heat to said fluid.

2. The system of claim 1, wherein said tubes have fins extending outwardly from diametrically opposed portions thereof, with the fins of adjacent tubes being welded together to form a gas-tight structure.

3. The system of claim 1, wherein said furnace section has a rectangular horizontal cross section.

4. The system of claim 1, wherein said acute angle extending tubes wrap around the furnace for at least one revolution.

5. The system of claim 1, wherein said separating section is connected between said vapor generating section and said superheating section.

6. The system of claim 1, wherein said fluid separating section receives fluid from said vapor generating section during start-up and full load operation of said system and separates said fluid into a liquid and a vapor.

7. The system of claim 6, wherein said fluid flow circuitry passes the vapor from said separating section to said superheating section during start-up and full load operation of said system.

8. The system of claim 6, wherein said separating means is adapted for connection to liquid flow means for passing the drain liquid from said separating means.

9. A vapor generating system comprising a furnace section the walls of which are formed by a plurality of tubes, said tubes extending vertically in the plane of each wall in the lower portions and upper portions of said walls and extending at an acute angle with respect to a horizontal plane in the intermediate portions of said walls extending between said upper and lower portions, means for simultaneously passing fluid through said tubes of all of said walls, and means for heating said fluid as it passes through said tubes.

10. The system of claim 9, wherein said tubes have fins extending outwardly from diametrically opposed portions thereof, with the fins of adjacent tubes being welded together to form a gas-tight structure.

11. The system of claim 9, wherein said acute angle extending tubes wrap around the furnace for at least one revolution.

12. The system of claim 9, further comprising a fluid separating section, a superheating section, and fluid flow circuitry connecting said sections in a series flow relationship.

13. The system of claim 12, wherein said separating section is connected between said furnace section and said superheating section.

14. The system of claim 12, wherein said fluid separating section receives fluid from said furnace section during start-up and full load operation of said system and separates said fluid into a liquid and a vapor.

15. The system of claim 14, wherein said fluid flow circuitry passes the vapor from said separating section to said superheating section during start-up and full load operation of said system.

16. The system of claim 14, wherein said separating means is adapted for connection to liquid flow means for passing the drain liquid from said separating means.

* * * * *